US005788476A

United States Patent [19]

Sher

[11] Patent Number: 5,788,476

[45] Date of Patent: Aug. 4, 1998

[54] CHILDPROOF PIEZOELECTRIC LIGHTER WITH SLIDING MECHANISM

[75] Inventor: Tak Chi Sher, North Point, Hong Kong

[73] Assignees: Polycity Industrial Ltd; Tak Fi Int'l. (Holdings) Ltd., both of Quarry Bay, Hong Kong

[21] Appl. No.: 861,368

[22] Filed: May 21, 1997

Related U.S. Application Data

[63] Continuation of Ser. No. 640,195, Apr. 30, 1996, abandoned.

[51] Int. Cl.[6] ..... F23D 11/36

[52] U.S. Cl. ..... 431/153; 431/255

[58] Field of Search ..... 431/153, 277, 431/255

[56] References Cited

U.S. PATENT DOCUMENTS

| | | | |
|---|---|---|---|
| 5,074,781 | 12/1991 | Fujita . | |
| 5,092,764 | 3/1992 | McDonough et al. . | |
| 5,145,358 | 9/1992 | Shike et al. | 431/153 |
| 5,165,885 | 11/1992 | Iwahori . | |
| 5,184,948 | 2/1993 | Iwahori . | |
| 5,186,618 | 2/1993 | Shik et al. . | |
| 5,197,870 | 3/1993 | Yang . | |
| 5,213,495 | 5/1993 | Pan . | |
| 5,215,458 | 6/1993 | Cirami . | |
| 5,224,854 | 7/1993 | Ansquer . | |
| 5,271,731 | 12/1993 | Husin-Chung . | |
| 5,334,011 | 8/1994 | Frigiere | 431/153 |
| 5,421,720 | 6/1995 | Sher . | |
| 5,435,719 | 7/1995 | McDonough et al. | 431/153 |
| 5,462,432 | 10/1995 | Kim | 431/153 |
| 5,492,468 | 2/1996 | Cirami | 431/153 |
| 5,538,417 | 7/1996 | Chan | 431/153 |

FOREIGN PATENT DOCUMENTS 0296281 12/1988 European Pat. Off. .

OTHER PUBLICATIONS

U.S. Patent application SN-08/700244, Aug. 20, 1996.

*Primary Examiner*—Carl D. Price

*Attorney, Agent, or Firm*—Burns, Doane Swecker & Mathis LLP

[57] ABSTRACT

A gas lighter uses the depression of an actuation lever to trigger a piezoelectric generator to generate a current and raise a gas lever to allow the flow of gas through a nozzle. The current is conducted to the nozzle to ignite the gas. A slider, movable towards and away from the body of the lighter is engaged with the actuating lever to not allow the actuating lever to be depressed when the slider is away from the body of the lighter. The engagement is by means of a pair of resilient fingers of the slider and pair of sliding surfaces on the actuating lever.

22 Claims, 5 Drawing Sheets

CHILDPROOF PIEZOELECTRIC LIGHTER WITH SLIDING MECHANISM

This application is a continuation of application Ser. No. 08/640,195, filed Apr. 30, 1996, now abandoned.

FIELD OF THE INVENTION

This invention relates to the field of lighters, such as cigarette lighters.

BACKGROUND OF THE INVENTION

Modern butane lighters have become very popular. One of the reasons for their popularity is that the height of the flame produced by the lighter can be varied over a wide range by varying the amount of fuel allowed to be ejected from the lighter. The very feature which makes such lighters attractive to the users also makes such lighters dangerous if they are accidentally ignited. When the lighter produces a flame in an uncontrolled circumstance, particularly when the lighter is set on its high setting, materials (such as curtains, clothing, hair) may accidentally be lit on fire. Also modem butane lighters suffer from the potential that the lever which actuates the lighter's nozzle will accidentally be depressed, thereby causing an unintended ejection of fuel, and therefore loss of fuel stored within the lighter body.

The invention disclosed herein significantly reduces the risk that the foregoing problems will be incurred by the provision of a safety lock feature which prevents the lighter's nozzle from begin put into the actuated position unless the user deliberately puts the lighter in an operational condition. In a preferred embodiment of the invention, the safety lock mechanism of the invention is automatically engaged.

SUMMARY OF THE INVENTION

Accordingly, it is an advantage of the present invention that a piezoelectric lighter using a slider as a safety lock mechanism.

Another advantage of the invention is to provide for a childproof lighter.

Yet another advantage of the present invention is to provide for the safety feature to be automatically engaged.

These and other advantages of the present invention are carried out in one form by a piezoelectric gas lighter with a lighter body. A nozzle, with a means for controlling gas flow through the nozzle, is attached to the lighter body. An electrical current generator is used to generate a current which is used to ignite the gas after it flows through the nozzle. An actuating lever is depressed to activate the flow of gas through the nozzle and activating the electrical current to ignite the gas. A slider, which is movable toward, and away from the lighter body is in engaged with the activating lever so that placement of the slider away from the lighter body prevents the actuating lever from being depressed while placement of the slider towards the lighter body allows the actuating lever to be depressed. The slider is designed so that it automatically moves away from the lighter body unless force is applied on the slider.

DETAILED DESCRIPTION OF THE PREFERRED EMBODIMENT

Figure 1:
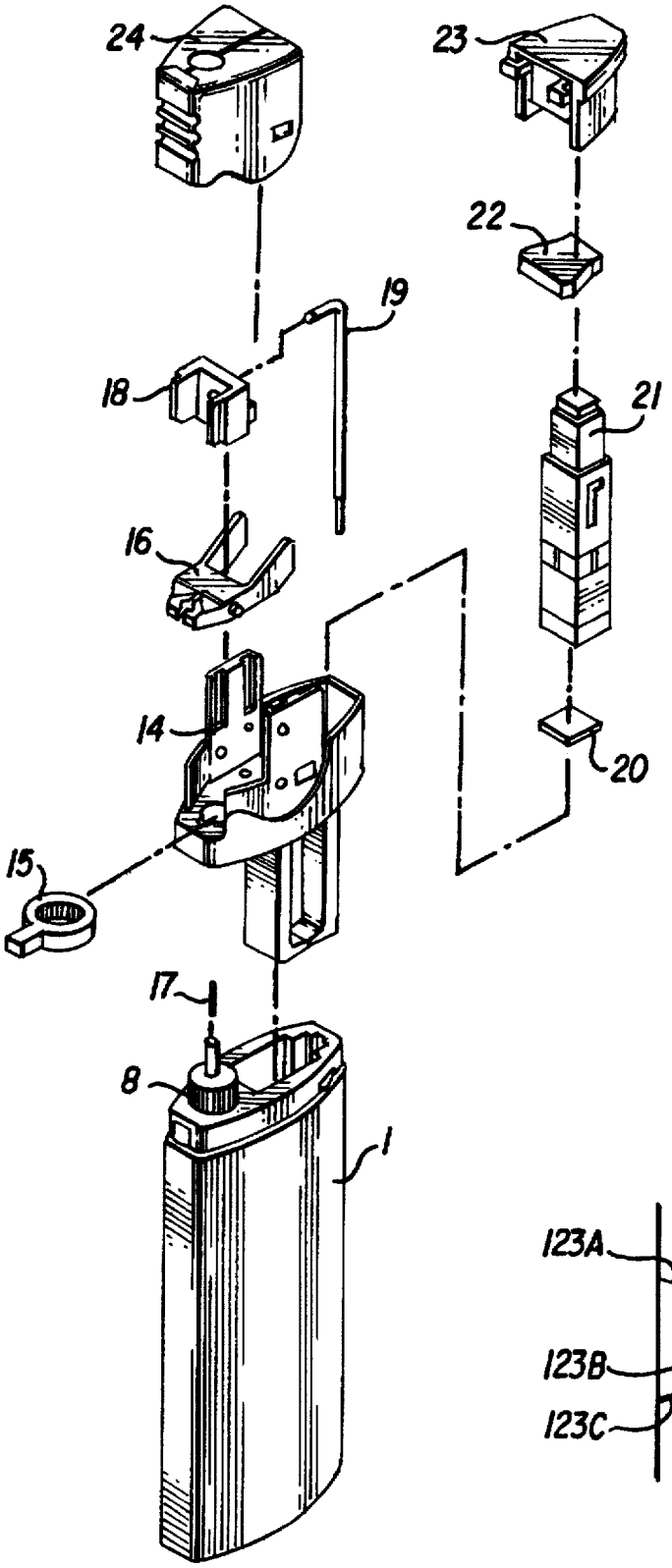
FIG. 1 (PRIOR ART)
FIG. 1 is an exploded view of a prior art piezoelectric lighter.

The preferred embodiment of the subject invention is illustrated in the attached drawings which are referred to herein. The same reference numeral will be used to identify identical elements throughout the drawings.

FIG. 1 illustrates components of a prior art piezo lighter commonly mounted on a lighter body 01. In normal operation, when actuating lever 23 is pressed downwards, the piezoelectric device is activated and generates an instant electric current which is conducted through conductor 19 to spring 17 inside the nozzle 08 as lighting source. The pressing of actuating lever 23 will simultaneously press the rear part of gas lever 16 downwards. As a result, the front part of gas lever 16 as well as the nozzle 08 is raised and causes ejection of fuel from lighter body 01 to light a flame. Such operations are simple and the lighter can be easily mis-handled by a child. In constructing such a device, various connecting pieces 15, 18, 20 and 22 may be used to keep the components in the proper placement.

Figure 2:
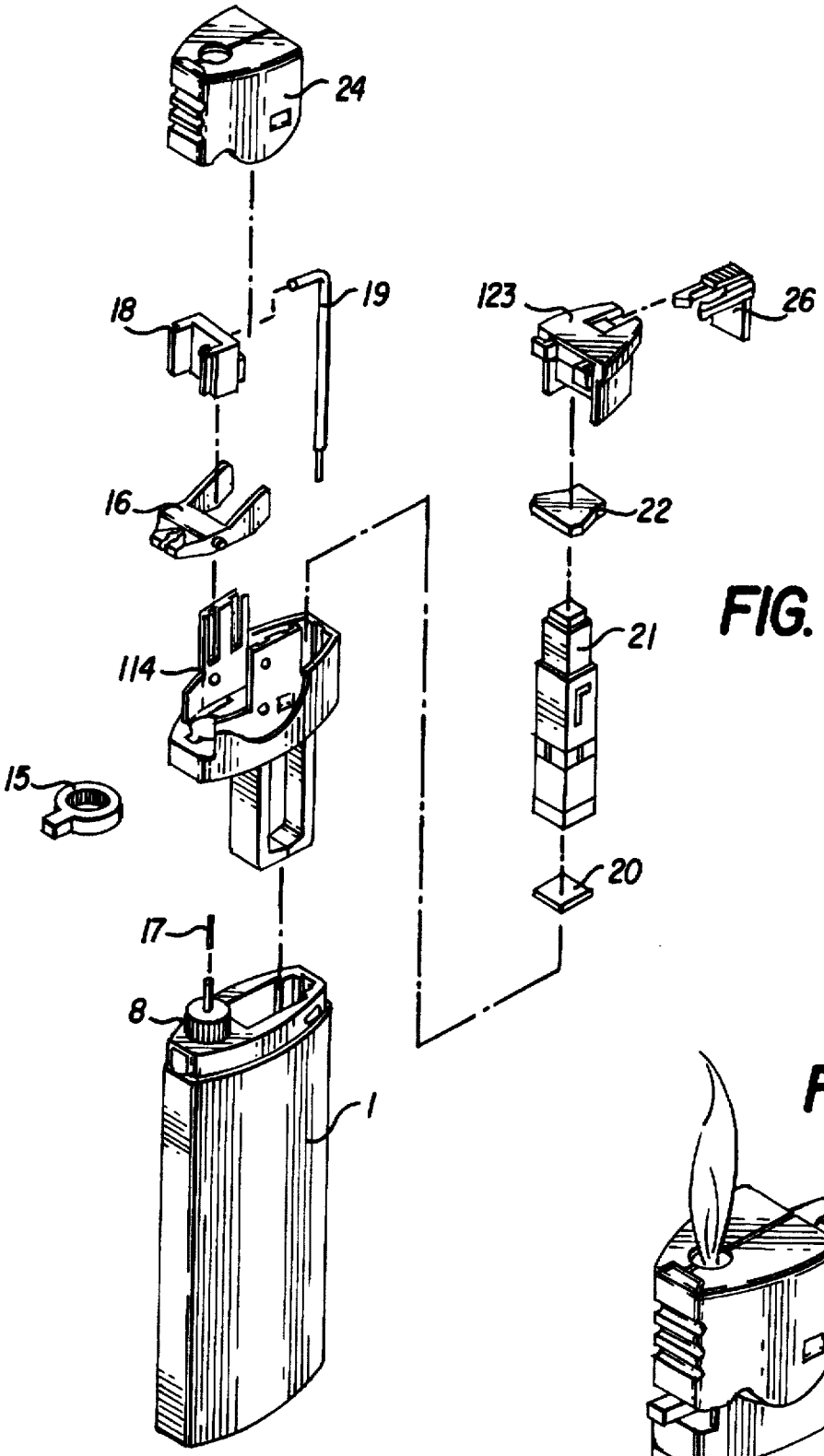
FIG. 2 is an exploded view of the safety lighter of the present invention.

As illustrated in FIG. 2, the configuration of the new actuating lever 123 and mounting frame 114, and the addition of slider 26 is to prevent children from lighting a flame with the lighter of the present invention. New actuating lever 123 is used to replace actuating lever 23. While the other components of the lighter may be changed, this is the only element which must be changed from the prior art.

Figure 3:
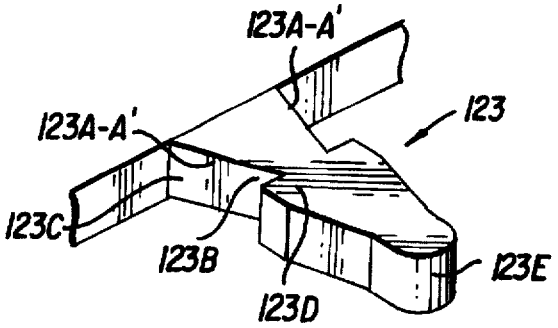
FIG. 3 is a perspective view of a component of safety device of the present invention.
Figure 4:
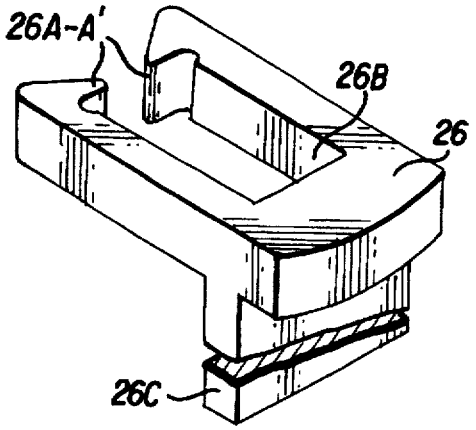
FIG. 4 is a perspective view of another component of safety slider of the present invention.

FIGS. 3 and 4 are drawings of the components featuring the inventive aspects of present invention. The movement of fingers 26A-A' of slider 26 along the sliding surface 123A-A' inside the actuating lever 123 can switch the lighter of the present invention from safety position to operational position and vice versa.

Figure 5:
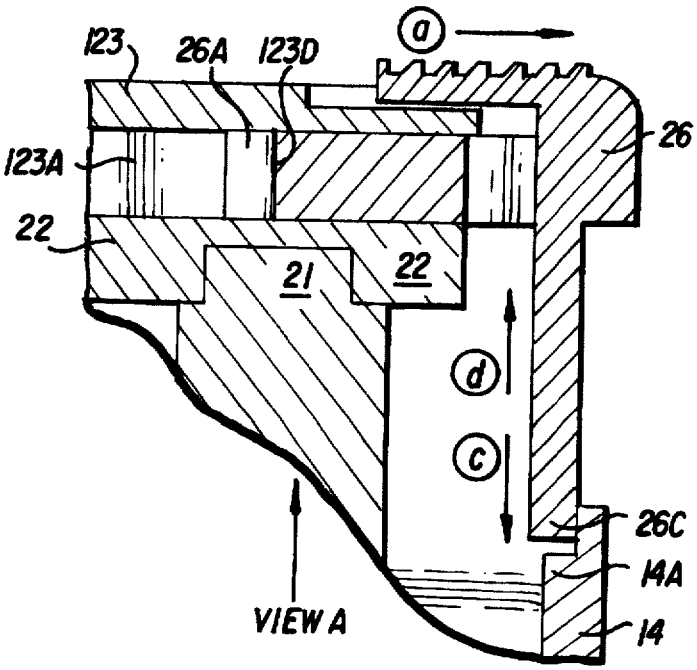
FIG. 5 is a partial sectional drawing of the lighter of the present invention in the safety position.
Figure 6:
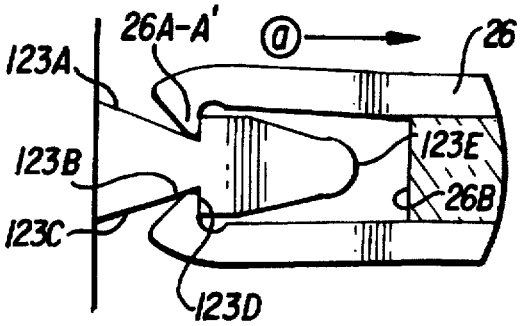
FIG. 6 is a drawing of VIEW A of the lighter of the present invention in the safety position as shown in FIG. 5.
Figure 7:
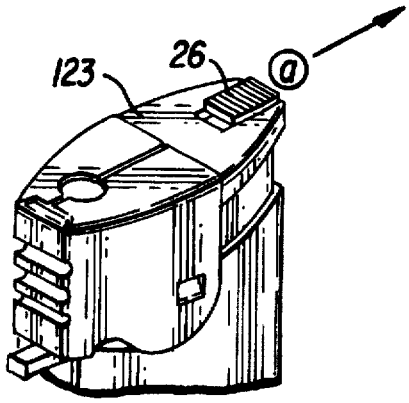
FIG. 7 is a partial perspective view of the lighter of the present invention in the safety position.

As illustrated in FIGS. 5, 6 and 7, fingers 26A-A' are designed to be resilient. When slider 26 slides in direction (a) →, away from the body of the lighter, fingers 26A-A' spontaneously moves to the same direction and will stop at lower stop point 123B due to the presence of the hooks at the end of fingers 26A-A' and the stopper 123D. Slider 26 therefore cannot move further. At this time, leg 26C of slider 26 will be blocked by stopper 14A on mounting frame 14 so that actuating lever 123 cannot be pressed down to direction © ↓. Simultaneously, the actuating lever 123 remains under the action of the resilient piezo in direction (d)↑.

Figure 8:
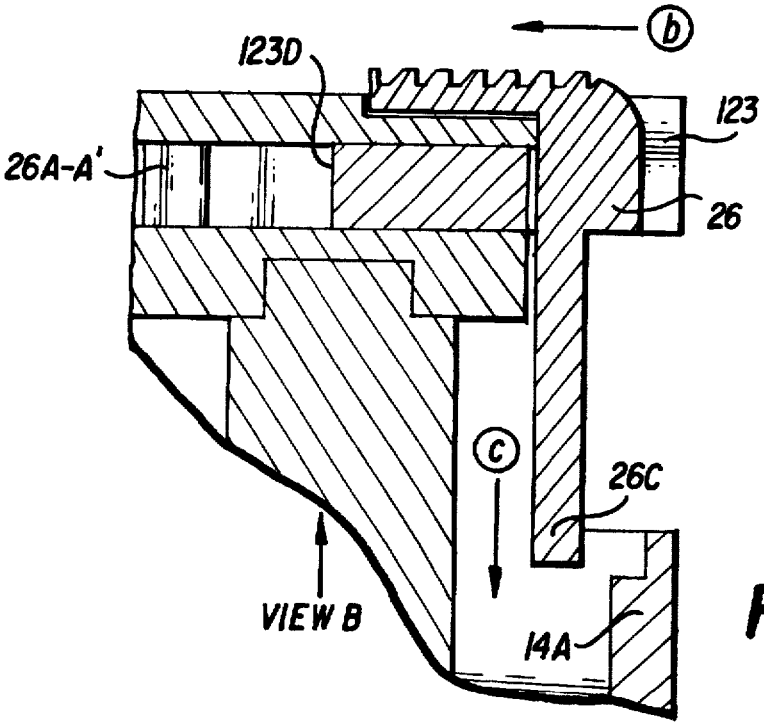
FIG. 8 is a partial sectional drawing of the lighter of the present invention in the operational position.
Figure 9:
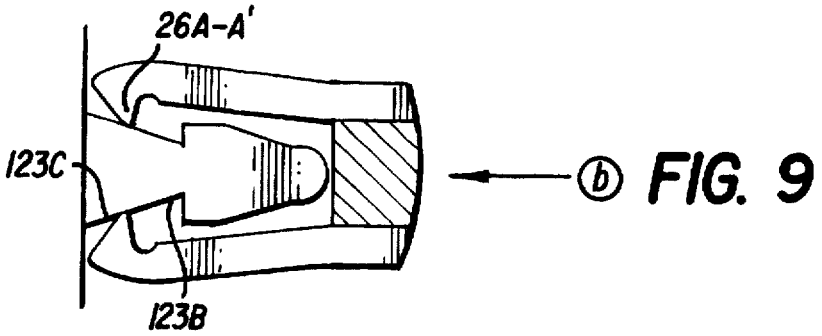
FIG. 9 is a drawing of VIEW B of the safety device in the operational position as shown in FIG. 8.
Figure 10:
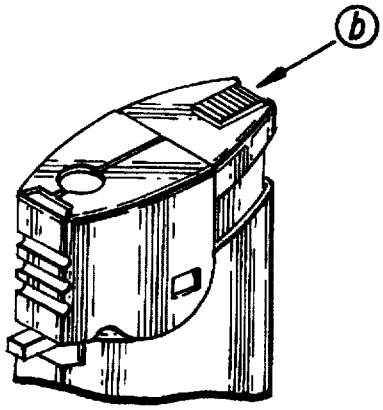
FIG. 10 is a partial perspective view of the lighter of the present invention in the operational position.

FIGS. 8, 9 and 10 illustrate the state in which the safety device is released. If slider 26 is pushed forward to direction ←(b), towards the body of the lighter, fingers 26A-A' of slider 26 moves to the upper stop point 123C at the inside of actuating lever 123 whereas leg 26C of slider 26 is released from stopper 14A. Therefore, the actuating lever can be pressed downward to direction © ↓.

Figure 12:
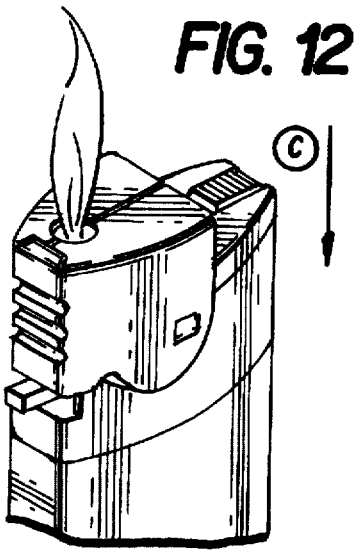
FIG. 12 is a partial perspective view of the lighter of the present invention showing the safety device, in which an igniting operation is being made.
Figure 11:
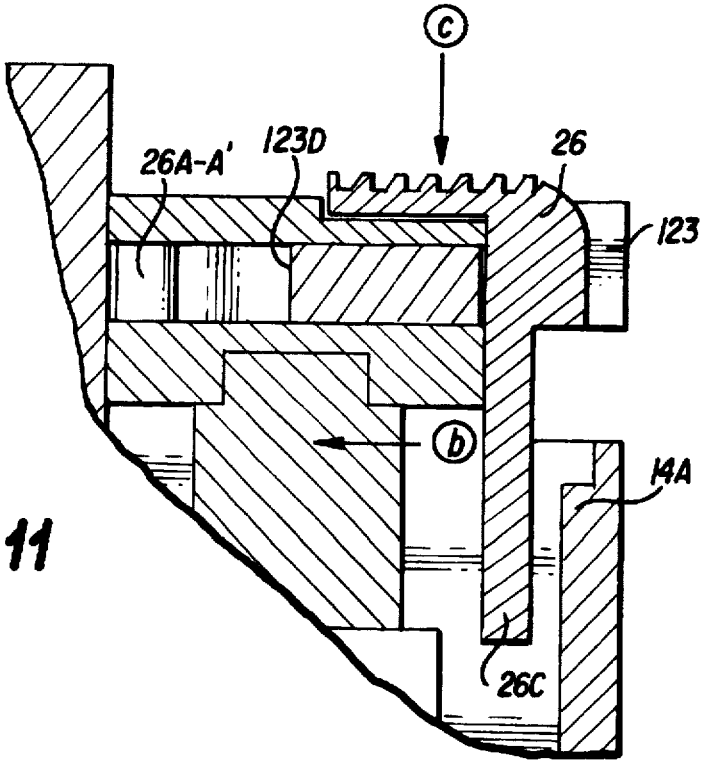
FIG. 11 is a partial sectional drawing of the lighter of the present invention showing the safety device, in which an igniting operation is being made.

FIGS. 11 and 12 show the safety device in the state when an igniting operation is being made. Press actuating lever 123 downward to direction © ↓ together with the released slider 26. An instant electric current is induced, conducted through conductor 19 to spring 17 inside the nozzle 08 and then ignites the gas ejected from the nozzle 08 as raised by gas lever 16.

Due to the resilience of piezo 21, the actuating lever 123 will be raised up to direction (d) ↑ and returns to the original position once the user's finger is removed.

If the force on slider 26 in direction ←(b) is removed, slider 26-A' will, under the action of its resilient fingers 26A-A', move along the sliding surface 123A inside the actuating lever 123 to the lower stop point 123B. Slider 26 will move in direction (a) →, its leg 26C will be blocked by stopper 14A of mounting frame 14 again and the lighter returns to the safety position. This feature thus provides for the automatic engagement of the safety feature after each use of the lighter.

Figure 13:
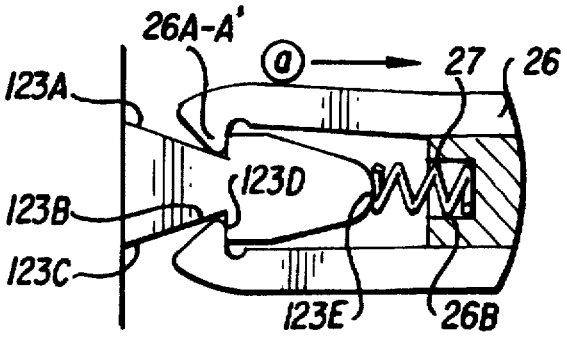
FIG. 13 is a drawing of VIEW A of the lighter of the present invention with a spring.

In an alternate embodiment of the invention, as shown in FIG. 13, the resilience of the slider 26 can be increased by using a resilient material placed in engagement with slider 26 and stopper 123, such as spring 27. The spring 27 is engaged with base 26B of slider 26 and the end 123E of actuating lever 123. Spring 27 applies force on slider 26 so that when no external force is applied to slider 26, the lighter returns to the safety position.

In yet an another alternative embodiment, which may or may not be used with the spring 27 described above, the sliding surface 123A-A' can be designed can be designed to force the slider 26 to return to the safety position after the external force being applied to slider 26 is removed. This can be done by constructing the two sliding surfaces 123A-A' so that they are not parallel. Such a construction acts to increase the resiliency of slider 26.

The present invention has been described above with reference to a preferred embodiment. However, those skilled in the art will recognize that changes and modifications may be made in this embodiment without departing from the scope of the present invention. Those skilled in the art will recognize that the various specific tasks and devices described herein in connection with this embodiment may be altered significantly without departing from the scope of the present invention. These and other changes and modifications which are obvious to those skilled in the art are intended to be within the scope of the present invention.

I claim:

1. A gas lighter comprising:

a lighter body;

a nozzle attached to said lighter body;

a gas flow means for controlling the flow of gas to said nozzle;

means for igniting said gas in said nozzle;

an actuating lever comprising a top surface and a pair of nonparallel sliding surfaces, said actuating lever controlling said gas flow means and said igniting means so that depressing the top surface of said actuating lever activates the flow of gas through said gas flow means to said nozzle and activates said igniting means;

a slider comprising a pair of resilient fingers in contact with said sliding surfaces of said actuating lever, said slider movable from a first position to a second position, said slider engaged with said actuating lever so that placement of said slider in the first position prevents said actuating lever from being depressed, wherein said slider must be in said second position in order for said actuating lever to be depressed, the action of said resilient fingers against said sliding surfaces urges said slider to said first position; and a portion of said slider extends above the top surface of the actuating lens.

2. The gas lighter according to claim 1 further comprising at least one metallic spring in engagement with said slider to increase the resilience of said slider.

3. The gas lighter according to claim 1, wherein each of said resilient fingers includes a hook on an end thereof and said actuating lever includes a pair of shoulders adjacent the nonparallel sliding surfaces, said hooks engage said shoulders when the slider is in the first position so as to retain the slider in contact with the actuating lever.

4. The gas lighter according to claim 3, further comprising a spring mounted between the actuating lever and the slider to coact with the resilient fingers to further urge the slider toward the first position.

5. The gas lighter according to claim 1, further comprising a spring mounted between the actuating lever and the slider to coact with the resilient fingers to further urge the slider toward the first position.

6. A gas lighter comprising:

a lighter body;

a mounting frame mounted in said lighter body, said mounting frame including a stopper;

a depressible actuating lever engaged with said mounting frame, said actuating lever comprising a top surface and a pair of sliding surfaces having an upper stop point and a lower stop point; and a slider comprising a main body, a pair of resilient fingers extending from said main body and engaged with said pair of sliding surfaces of said actuating lever between said upper stop point and said lower stop point, and a leg, said leg engaged with the stopper when said pair of resilient fingers is engaged with said pair of sliding surfaces at said lower stop point, said leg is not engaged with said stopper when said pair of resilient fingers is engaged with said pair of sliding surfaces at said upper stop point, and the resiliency of said resilient fingers forces said resilient fingers to said lower stop point when no external force is applied to said slider, and a portion of said slider extends above the top surface of the actuating lever;

wherein said engagement between said leg and said stopper prevents said actuating lever from being depressed and said nonengagement allows said actuating lever to be depressed.

7. A gas lighter according to claim 6 further comprising at least one metallic spring engaged with said slider to increase the resilience of said slider.

8. The gas lighter according to claim 6 wherein said resilient fingers are made from a resilient plastic.

9. The gas lighter according to claim 6 wherein said actuating lever further comprises a head extending away from said sliding surfaces and toward said main body of said slider, said head engaged to said sliding surface at said lower stop point whereby said head prevents said slider from being removed from said main body.

10. The gas lighter according to claim 9 wherein said head of such actuating lever is adjacent said main body of said slider.

11. The gas lighter according to claim 9 wherein the angle of said sliding surface in relation to said head is designed to enhance the resilience of said slider.

12. The gas lighter according to claim 6, wherein each of said resilient fingers includes a hook on an end thereof and said actuating lever includes a pair of shoulders adjacent the nonparallel sliding surfaces, said hooks engage said shoulders when the slider is in the first position so as to retain the slider in contact with the actuating lever.

13. The gas lighter according to claim 12, further comprising a spring mounted between the actuating lever and the slider to coact with the resilient fingers to further urge the slider toward the first position.

14. The gas lighter according to claim 6, further comprising a spring mounted between the actuating lever and the slider to coact with the resilient fingers to further urge the slider toward the first position.

15. A lighter which uses gas to form a flame comprising:

a lighter body, said gas stored within said body;

a nozzle attached to said lighter body through which gas can flow;

a movable gas lever mated to said lighter body so that movement of said gas lever allows said gas to flow to said nozzle;

a piezoelectric generator electrically connected to said nozzle;

a mounting frame mounted in said lighter body, said mounting frame including a stopper;

a depressible actuating lever engaged with said mounting frame, said actuating lever comprising a top surface, a head, and a pair of sliding surfaces, said pair of sliding surfaces having an upper stop point and a lower stop, said head connected to said pair of sliding surfaces at said lower stop point; a slider comprising a main body, a pair of resilient fingers, and a leg, said pair of fingers extending from said main body and engaged with said actuating lever along said pair of sliding surfaces between said upper stop point and said lower stop point; said leg engaged with said stopper when said pair of resilient fingers is engaged with said pair of sliding surfaces at said lower stop point to prevent said actuating lever from being depressed; said leg not engaged with said stopper when said pair of resilient fingers is engaged with said pair of sliding surfaces substantially at said upper stop point to allow said actuating lever to be depressed; and wherein the resiliency of said resilient fingers forces said resilient fingers to be engaged with said pair of sliding surfaces at said lower stop point when no force is applied to said slider;

a portion of said slider extends above the top surface of the actuating lever; and wherein depressing said actuating lever raises said gas lever and activates said piezoelectric generator.

16. The lighter according to claim 15, wherein each of said resilient fingers includes a hook on an end thereof and said actuating lever includes a pair of shoulders adjacent the nonparallel sliding surfaces, said hooks engage said shoulders when the slider is in the first position so as to retain the slider in contact with the actuating lever.

17. The lighter according to claim 16, further comprising a spring mounted between the actuating lever and the slider to coact with the resilient fingers to further urge the slider toward the first position.

18. The lighter according to claim 15, further comprising a spring mounted between the actuating lever and the slider to coact with the resilient fingers to further urge the slider toward the first position.

19. The lighter according to claim 15 wherein the angle of said pair of sliding surface in relation to said head is designed to enhance the resilience of said slider.

20. The lighter according to claim 15 further comprising a spring located around said nozzle and a conductor connected to said piezoelectric generator and said spring, wherein said current generated by said piezoelectric generator is conducted through said conductor and said spring to reach said nozzle.

21. The lighter according to claim 15 where said slider must be released substantially simultaneously with depressing said actuating lever in order for said actuating lever to be depressed.

22. The lighter according to claim 15 further comprising a spring in engagement with said depressable actuating lever and said slider wherein said spring pushes said slider whereby said leg is engaged with said stopper unless an external force is applied to said slider.

* * * * *